United States Patent [19]

Tamplen et al.

[11] 4,396,061

[45] Aug. 2, 1983

[54] LOCKING MANDREL FOR A WELL FLOW CONDUCTOR

[75] Inventors: Jack W. Tamplen, Celina; Colby M. Ross, Irving; Timothy J. Noack, Lewisville; Jimmie R. Williamson, Jr., Carrollton, all of Tex.

[73] Assignee: Otis Engineering Corporation, Dallas, Tex.

[21] Appl. No.: 229,121

[22] Filed: Jan. 28, 1981

[51] Int. Cl.[3] ..... E21B 17/043

[52] U.S. Cl. ..... 166/217; 166/237; 285/86

[58] Field of Search ..... 166/125, 214, 217, 237; 285/84, 85, 86, 315

[56] References Cited

U.S. PATENT DOCUMENTS

| | | | |
|---|---|---|---|
| 2,871,947 | 2/1959 | Fredd | 166/214 |
| 3,130,788 | 4/1964 | Cochran et al. | 166/217 |
| 3,208,531 | 9/1965 | Tamplen | 166/125 |
| 3,430,699 | 3/1969 | DeCuir | 166/217 |
| 3,502,144 | 3/1970 | Young | 166/237 |
| 4,023,620 | 5/1977 | Gazda et al. | 166/217 |
| 4,161,984 | 7/1979 | Watkins | 166/217 |
| 4,164,977 | 8/1979 | Arendt et al. | 166/125 |

FOREIGN PATENT DOCUMENTS

| | | | |
|---|---|---|---|
| 887150 | 1/1962 | United Kingdom | 166/125 |

*Primary Examiner*—James A. Leppink
*Assistant Examiner*—William P. Neuder
*Attorney, Agent, or Firm*—H. Mathews Garland

[57] ABSTRACT

In a locking mandrel for releasably locking a well tool in a well flow conductor of the type disclosed in U.S. Pat. No. 3,208,531 which includes a tubular body mandrel adapted for securing with a running tool and with a well tool, a locking dog retainer sleeve on the body mandrel, expandible and contractible locking dogs carried by the retainer sleeve, and a locking sleeve movable on the body mandrel within the retainer sleeve between a first position at which the locking dogs are expanded and release positions at which the locking dogs are movable inwardly to release positions, the improvement for releasably latching the locking sleeve at the first locking position on the body mandrel which includes an annular latching boss on the body mandrel and an annular latching flange and recess within the locking sleeve. When the locking sleeve is moved to the first locking position the latching flange passes over the latching boss which is received in the latching recess of the locking sleeve releasably latching the locking sleeve at the first position on the body mandrel. The locking sleeve is unlatched by movement to one of the release positions at which the latching boss moves out of the latching recess. The improved latching structure prevents accidental unlocking of the locking mandrel at low flow rates through the tool.

7 Claims, 4 Drawing Figures

LOCKING MANDREL FOR A WELL FLOW CONDUCTOR

Figure 1B:
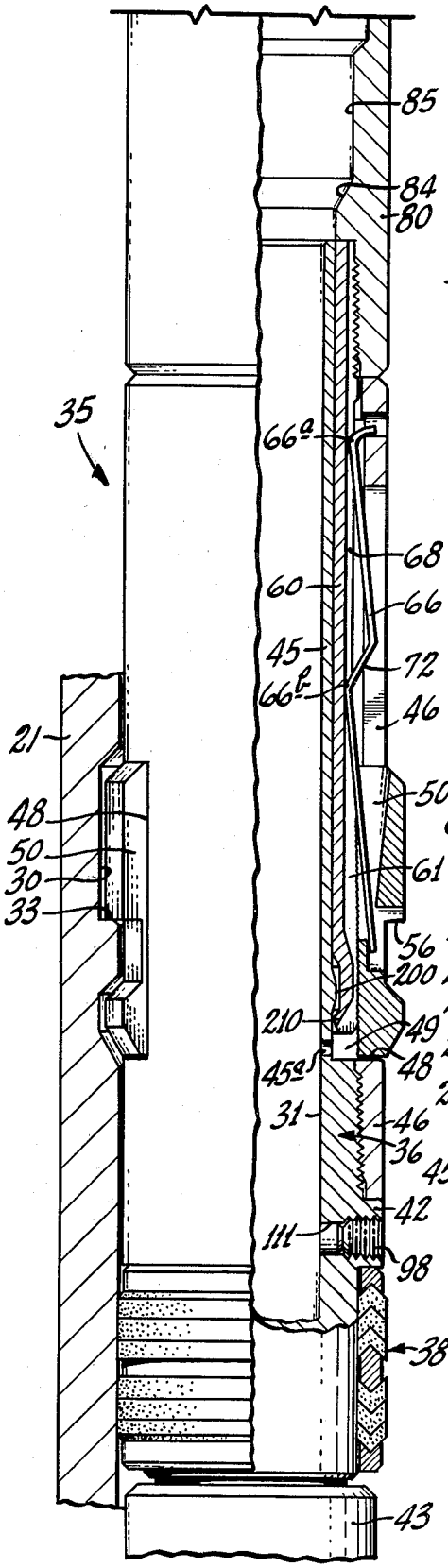

This invention relates to well tools and more particularly to locking mandrels for locking well flow control and similar tools in place in a flow conductor in a well such as an oil or gas well. More specifically, this invention relates to an improvement in the locking mandrel disclosed and claimed in U.S. Pat. No. 3,208,531 issued Sept. 28, 1965, entitled INSERTING TOOL FOR LOCATING AND ANCHORING A DEVICE IN TUBING.

The locking mandrel of U.S. Pat. No. 3,208,531 has structural features including serrated surfaces 75 on the locking sleeve 60 and 76 in the locking dogs 50 which are urged together in direct proportion to the pressure differential across the tool to prevent upward movement of the locking sleeve from within the dogs. These features insure that high pressure differentials across the tool will not unlock the tool from a landing nipple. As a pressure differential increases across the tool when locked in a landing nipple, the engagement between the sloping surfaces on the locking dogs 50 with the sloping surfaces along the landing and locking groove 30 in the landing nipple cams the locking dogs inwardly around the locking sleeve increasing the force between the serrated surfaces 75 and 76 and thus increasing the holding force resisting the movement of the locking sleeve upwardly which would unlock the mandrel. It has been found, however, that these features which resist disengagement of the locking mandrel at high pressure differentials are not effective at low flow rates through the tool which create turbulence in the pulling sleeve area of the tool along the recess 85 which tends to lift the locking sleeve sufficiently to unlock the dogs 50. At this low flow rate which creates the turbulence there is not sufficient pressure drop across the tool to cause the locking dogs to be cammed inwardly against the locking sleeve with enough force to overcome the disengaging upward force on the sleeve caused by the turbulence. Further, when the mandrel is designed to support a heavy valve, the support shoulder on the dogs and in the landing nipple are abrupt shoulders which do not urge the dogs inwardly under low load conditions resulting in the locking sleeve being so loose it is easily raised by low flow rates. Thus, while the locking mandrel of U.S. Pat. No. 3,208,531 effectively resists disengagement at high pressure drops across the tool, the locking mandrel does tend to disengage and release from a landing nipple at low flow rates.

Unsuccessful efforts to solve the problem of inadvertent unlocking of the locking sleeve in the locking mandrel of U.S. Pat. No. 3,208,531 have included the use of shear pins and snap rings as latches. In each instance the latching device moves to a locking position when the locking sleeve is moved downwardly behind the locking dogs. It has been found that in wells in which sand is common the sand tends to pack around the shear pins and the snap rings preventing movement to latching positions when needed. Thus, such devices have been found to malfunction under operating conditions such as when sand is produced in a well.

It is, therefore, a principal object of the invention to provide a new and improved well tool.

It is another object of the invention to provide a new and improved locking mandrel for a flow conductor of a well to releasably lock well tools such as valves in the flow conductor.

It is a particular object of the invention to provide a new and improved locking mandrel of the type disclosed and claimed in U.S. Pat. No. 3,208,531.

It is a still more specific object of the invention to provide new and improved structure in the locking mandrel of U.S. Pat. No. 3,208,531 for preventing accidental disengagement of the locking dogs of the mandrel by low flow rate turbulence which tends to move the locking sleeve of the mandrel upwardly to a position at which the locking dogs are released.

It is still another object of the invention to provide improved means for holding the locking sleeve of the lock mandrel as disclosed in U.S. Pat. No. 3,208,531 which does not reduce the resistance of the tool to disengagement where high pressure differentials are applied across the tool.

In accordance with the invention, improved means for preventing accidental disengagement of the locking sleeve of the locking mandrel as disclosed in U.S. Pat. No. 3,208,531 includes an internal annular locking flange along the lower end portion of the locking sleeve and an external annular locking boss around the tubular mandrel on which the sleeve is mounted. The locking sleeve has an internal annular recess inward from the locking flange which is slightly longer than the locking boss on the tubular mandrel. When the locking sleeve is driven downwardly on the mandrel, the locking flange latches over the locking boss holding the locking sleeve against release.

Figure 3:
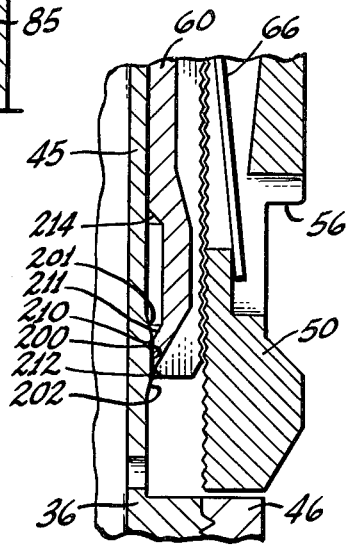
Figure 2:
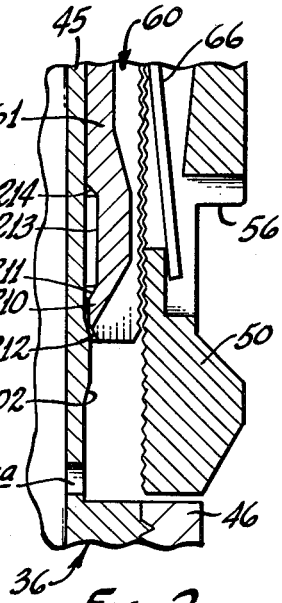
Figure 4:
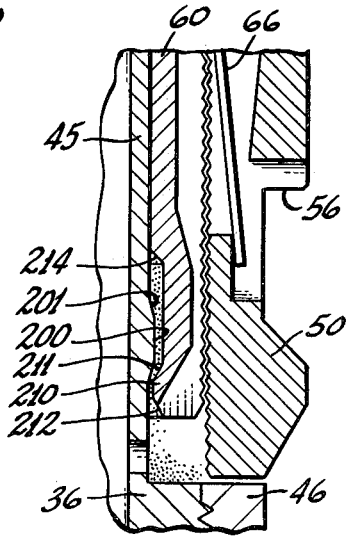

The invention and its objects and advantages will be better understood from the following detailed description of a preferred embodiment thereof taken in conjunction with the accompanying drawings wherein:

FIGS. 1A and 1B taken together form a longitudinal view in section and elevation of a locking mandrel embodying the features of the invention;

FIG. 2 is an enlarged fragmentary view in section and elevation showing the locking sleeve, body mandrel, and one of the locking dogs of the locking mandrel before the locking sleeve is driven downwardly to a locking position on the body mandrel;

FIG. 3 is a fragmentary view in section and elevation similar to FIG. 2 showing the locking sleeve being driven downwardly as the locking flange in the sleeve passes over the locking boss on the body mandrel; and FIG. 4 is a fragmentary view in section and elevation similar to FIGS. 2 and 3 showing the locking sleeve at a lower end locking position on the body mandrel with some formation sand along the body mandrel within the sleeve.

Referring to FIGS. 1A and 1B, a locking mandrel 35 including the features of the invention includes a tubular body mandrel 36 provided with a bore 37 and on which an external annular packing assembly 38 is mounted. The lower end portion of the body mandrel 36 is connected into a well tool such as a valve 43 supported from the locking mandrel 35. The body mandrel 36 has a tubular upper portion 45 which is substantially reduced in diameter and provided with a plurality of circumferentially spaced ports **45*a* around the lower end of the portion 45 at the junction with the larger externally threaded main body portion of the body mandrel 36. A dog carrying or key retainer sleeve 46 is threaded along the lower end portion on the externally threaded portion of 47 of the body mandrel 36 above the external annular flange 42 on the body mandrel 36**.

The sleeve 46 has a pair of diametrically opposed longitudinal lateral windows 48 in which a pair of radially expandable and contractable locking dogs or keys 50 are mounted. The locking dogs have external locating and locking bosses which fits the internal annular locating and locking recesses 30 of a landing nipple 21 in which the locking mandrel may be landed and locked for supporting the well tool 43 in the flow conductor. The bore of the sleeve 46 is sufficiently larger than the reduced body mandrel portion 45 to define an annular space 49 between the members in which an elongated locking sleeve 60 is telescopically engaged for longitudinal movement between locking dog expanded and release positions. The locking sleeve 60 is threaded along an upper end portion into the tubular fishing neck or sleeve 80 which has an internal annular groove 85 and shoulders 84 and 86 which function with a handling tool used for setting and releasing the locking mandrel 35. The locking sleeve 60 has an enlarged lower end portion 61 having an external serrated surface which is compatible with an internal serrated surface within each of the locking dogs 50 for holding the locking sleeve 60 against upward movement when the dogs are urged inwardly around the locking sleeve by a high pressure differential across the locking mandrel 35 when the mandrel is locked in place in the landing nipple. The locking sleeve 60 has a pair of diametrically opposed longitudinal slots or grooves 68 in each of which is positioned an elongate spring member 66. The springs 66 are flat leaf-type springs which are confined between the sleeve 46 and the sleeve 60 coupled with the dogs 50 for expanding and contracting the locking dogs depending upon the longitudinal position of the locking sleeve 60 during the running, setting and pulling of the locking mandrel 35.

Each of the locking dogs 50 has an abrupt downwardly facing support shoulder 56 which is engageable with an internal annular upwardly facing abrupt stop shoulder 33 in the landing nipple 21. The abrupt stop shoulders are important where the weight of the well tools such as a valve 43 applies a substantial downward force in the flow conductor on the supporting locking mandrel 35. Since the support shoulders are abrupt shoulders rather than sloping shoulders, the weight of the well tool 43 on the locking mandrel does not apply an inward biasing force on the locking dogs which would be applied if the engaging shoulders were downwardly sloping shoulders as in some similar locking mandrels. Since the locking dogs are not biased inwardly by the weight of the tool 43, under conditions when there is no large upward pressure differential across the locking mandrel 35, the locking sleeve 60 is not held tightly by the locking dogs and thus is relatively free to move upwardly. Under these circumstances, a low flow through the locking mandrel creating turbulence in the fishing neck recess 85 area tends to lift the locking sleeve 60 which will inadvertently unlock or release the locking mandrel dogs 50. Therefore, in accordance with the invention, special latching features are provided along the locking sleeve 60 and the reduced tubular portion 45 of the body mandrel 36 over which the locking sleeve 60 telescopes. The body mandrel tubular portion 45 is provided along the lower end portion above the ports **45*a* with an external annular locking or latching boss 200 extending between upper and lower sloping cam shoulders 201 and 202 respectively. The shoulders 201 and 202 are preferably formed at approximately a 15 degree angle with the longitudinal axis of the body mandrel tubular portion 45. Further, in accordance with the invention, the enlarged lower end portion 61 of the locking sleeve 60 has an internal annular latching or locking flange 210 between sloping upper and lower shoulders 211 and 212 respectively. The locking sleeve end portion 61 also has an internal annular recess 213 spaced from the end of the member defined between the sloping shoulder surface 211 and an upper end sloping shoulder surface 214. The bore through the latching flange 210 of the locking tube 60 is smaller than the outside diameter of the latching boss 200 on the tubular member 45. The relation between or relative dimensions of the latching flange 210 and the latching boss 200 are established to permit the latching flange to pass over the latching boss by stretching within the elastic limits of the material of which the locking sleeve 60 is formed. The latching flange 210 must be able to stretch sufficiently to pass below the latching boss 200 and contract below the latching boss to lock or latch the sleeve 60 against upward movement so that the locking dogs 50 are not inadvertently released by accidental upward movement of the locking sleeve 60. It will be recognized that the relative dimensions of the latching flange 210 and the latching boss 200 are critical inasmuch as if the elastic limit is exceeded in the material forming the locking sleeve, the latching flange would not return to the required smaller diameter necessary to coact with the latching boss to lock the sleeve 60 at the downward position. Further, the length of the recess 213 must be greater than the length of the boss 200 as measured between the sloping shoulder surfaces defining the recess and the boss so that when the latching flange 210 is in the latching position below the latching boss 200, there is a degree of tolerance or freedom between the flange and the boss so that the flange is not held in a stretched or stress condition which over a period of time would induce fatigue failure in the locking tube 60. Such fatigue failure would cause the inadvertent or accidental release of the locking sleeve. Of course the sloping shoulders at the opposite ends of the latching boss 200 and the latching flange 210** provide a smooth cam action between the flange and the ball for latching and unlatching the locking sleeve with the mandrel.

The body mandrel 36 has a transverse opening 111 for a shear pin used to connect the locking mandrel 35 with a running tool which supports the mandrel from a wire line and operates the mandrel during the expanding and locking of the dogs 50 into the locking recesses 30 of the landing nipple 21. A set screw 98 in the outer threaded portion of the opening 111 holds the shear pin in place. Further details of the structural features of the locking mandrel 35 and of a running tool R are described and illustrated in detail in U.S. Pat. No. 3,208,531 which also describes in detail the procedures followed during the running, setting and pulling of the locking mandrel 35. The specification and drawings relating to the structural details and operating procedures of the locking mandrel 35 not included herein are incorporated by reference from U.S. Pat. No. 3,208,531. The structural features and operating procedures of the locking mandrel 35 of the invention are identical to those described and identified in U.S. Pat. No. 3,208,531.

Figure 1B:
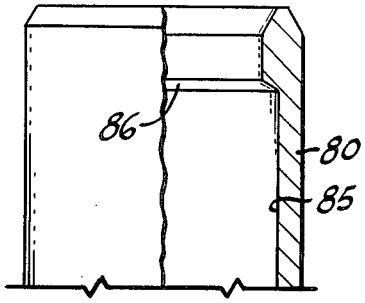

For running the locking mandrel 35 into a flow conductor and landing and locking the mandrel in a landing nipple 21, the locking mandrel is assembled with the running tool R in the relationship illustrated in FIGS. 1 and 2 of the U.S. Pat. No. 3,208,531 which show the locking mandrel and the running tool as the tools are run into a well bore on a wire line L. As illustrated in FIG. 2 of the patent, the locking sleeve 60 is at an upper position at which the sleeve extends below an upper end hook 66*a* of the spring 66 terminating above a bend 66*b* of the spring. At this position of the locking sleeve, the spring 66 biases the locking dogs inwardly closely around the locking mandrel body so that the dogs do not drag along the flow conductor wall. Supported by the running tool, the locking mandrel 35 is lowered below the landing nipple 21 in which it is to be landed and locked. In accordance with the procedure outlined in the U.S. Pat. No. 3,208,531, the running tool and locking mandrel are then lifted back upwardly above the landing and locking recesses of the landing nipple and thereafter lowered again toward the landing nipple. This last step of lowering the running tool and locking mandrel causes the locking sleeve 60 to be moved downwardly to an intermediate position as represented in FIG. 5 at which the lower end portion of the locking sleeve 60 is behind the reverse bend 72 along the bend portion 66*b* of the spring 66 so that the spring urges the locking dogs 50 outwardly against the wall of the flow conductor. The lowering of the running tool and locking mandrel is continued with the dogs 50 dragging along the flow conductor wall. When the dogs arrive at the landing and locking recess 30 of the landing nipple 21, the dogs are expanded into the landing and locking recesses to the position shown in FIG. 1A herein and FIG. 10 of the U.S. Pat. No. 3,208,531.

With the locking dogs 50 of the locking mandrel 35 expanded into the landing and locking recesses 30 of the landing nipple 21, standard wire line procedures as discussed in U.S. Pat. No. 3,208,531 are employed to apply downward jarring forces to the running tool and locking mandrel for driving the locking sleeve 60 downwardly to the lower end position represented in FIG. 1A herein and in FIGS. 10 and 12 of U.S. Pat. No. 3,208,531 for locking the dogs 50 in the expanded locking positions in the landing nipple.

In accordance with the present invention as the locking sleeve 60 is driven downwardly to the locking position of FIG. 1A, the sleeve is latched at the lower end locking position by the coaction between the locking flange 210 within the sleeve and the locking boss 200 on the locking mandrel body tube 45. FIGS. 2, 3, and 1A herein illustrated the step-wise procedure of latching the locking sleeve 60 with the locking mandrel body tube 45. FIG. 2 shows the locking sleeve as the lower end portion of the sleeve moves downwardly approaching the latching boss 200. Initially, the sloping shoulder 212 on the lower end of the latching flange 210 engages the latching boss shoulder 201 expanding or stretching the latching flange 210 of the locking sleeve to the extent that the flange 210 may pass downwardly along the latching boss as shown in FIG. 3 at which position the locking sleeve latching flange is stretched sufficiently to clear the latching boss. The stretch of the material forming the lower end portion of the locking sleeve including the latching flange is within, or stated otherwise, less than the elastic limit of the material. The downward movement of the locking sleeve continues from the position in FIG. 3 at which the latching flange is passing over the latching boss to the lower end position of FIG. 1A at which the latching flange 210 is below the latching boss 200. As soon as the latching flange 210 passes the latching boss 200, the lower end portion of the locking sleeve including the latching flange shrinks back to a diameter at which the bore through the latching flange is less than the outside diameter of the latching boss so that the locking sleeve is held at the lower end locking position within the dogs 50. Since the elastic limit of the material forming the locking sleeve was not exceeded when the latching flange passed over the latching boss, the material readily shrinks back to the size prior to passing over the latching boss so that the flange bore is smaller than the boss to hold the locking sleeve at the lower end position. The length of the recess 213 above the flange 210 exceeds the length of the latching boss so that at the latching position of the locking sleeve shown by FIG. 1A, the latching sleeve is slightly loose thereby not imposing a stress on the lower end portion of the sleeve. This is very important because continued permanent stress under well conditions which frequently may include the presence of hydrogen sulfide which is highly corrosive would result in fatigue failure of the locking sleeve. It will be evident, of course, that should fatigue failure occur in the locking sleeve the locking mandrel can accidentally become unlocked. With the tolerances outlined between the locking sleeve recess 213 above the latching flange 210 and the latching boss 200, the locking sleeve is never under stress and thus such fatigue failure does not occur.

With the locking sleeve 60 at the lower end position of FIG. 1A, in accordance with the invention, the locking sleeve is latched against inadvertent upward movement and holds the locking dogs 50 expanded in the locking recesses of the landing nipple. The running tool R is removed following the procedures outlined in my U.S. Pat. No. 3,208,531. A high flow rate upwardly through the locking mandrel 35 imposes a pressure differential across the mandrel tending to lift the mandrel resulting in the coaction between the downwardly sloping surfaces within the landing nipple recesses and on the dogs 50 to urge the dogs 50 inwardly toward the locking sleeve 60. The serrated inner surfaces of the dogs 50 engaging the serrated outer surface of the locking sleeve along the lower end portion of the sleeve as evident in FIGS. 1A and 2, herein, holds the locking sleeve 60 against movement upwardly to an unlocking position at high pressure differentials. In accordance with the features of my invention, low flow rates which are not sufficient to urge the dogs 50 inwardly will create a turbulence in the fishing neck recess area 85 at the head of the locking mandrel tending to lift the relatively loose locking sleeve 60. This lifting force on the locking sleeve is resisted by the latching of the locking sleeve by the latching flange 210 below the latching boss 200. The low flow rate turbulence therefore does not accidentally release the dogs 50 on the locking mandrel.

When removal of the locking mandrel 35 is desired, a retrieving tool and the procedural steps outlined in my U.S. Pat. No. 3,208,531 are employed. The locking mandrel is released by lifting the locking sleeve 60 back upwardly to an upper end position at which the dogs 50 are free to move inwardly out of the landing nipple locking recesses. In pulling the locking sleeve 60 back upwardly the latching flange 210 of the locking sleeve must move back above the latching boss 200 on the body mandrel 36. In the event that sand in the well bore is packed around the body mandrel tube 45 along the latching boss 200 within the locking sleeve 60 along the lower end portion as shown in FIG. 4, herein, a scissorlike effect between the latching flange 210 and the latching boss 200 simply shears the sand pushing grains aside as the locking sleeve is lifted on the body mandrel. It will be evident in FIG. 4, herein, that the sand within the recess 213 is lifted with the locking sleeve as the sleeve passes upwardly over the latching boss 200. The shearing effect between the latching flange and latching boss brushes the sand along the boss so that it does not interfere with the unlatching of the locking sleeve 60.

It will now be seen that a new and improved form of my locking mandrel has been described and illustrated. It will now be seen that the latching features of my invention prevent inadvertent locking of my mandrel under low fluid flow conditions.

What is claimed is:

1. In a locking mandrel for releasably locking well tools in a flow conductor of a well, said locking mandrel having a tubular body mandrel, a locking dog retainer sleeve on said body mandrel, expandible and contractible locking dogs carried by said retainer sleeve, and a locking sleeve movable on said body mandrel within said retainer sleeve between a first locking position at which said dogs are expanded in locking relationship and release positions retracted from within said dogs, the improvement which comprises: a locking boss fixed along one of said locking sleeve or said body mandrel; and a locking recess along the other of said locking sleeve or said body mandrel to receive said locking boss; and said locking boss and said locking recess being aligned along said body mandrel and said locking sleeve to engage in locking relationship when said locking sleeve is at said first locking position and to misalign in release relationship of said locking sleeve when said locking sleeve is moved to one of said release positions.

2. The locking mandrel of claim 1 wherein said locking recess is longer than said locking boss providing a loose fit whereby each of said locking sleeve and said body mandrel is in a non-stress condition in said locking relationship.

3. The locking mandrel of claim 2 wherein the surfaces on said body mandrel and said locking sleeve are dimensioned to stress the material forming said locking sleeve and said body mandrel below the elastic limit of said material when said locking sleeve moves between said first locking position and said release positions.

4. In a locking mandrel for releasably locking well tools in a flow conductor of a well, said locking mandrel having a tubular body mandrel, a locking dog retainer sleeve on said body mandrel, locking dogs carried by said retainer sleeve for expansion and contraction between locking and release positions, and a locking sleeve movable on said body mandrel within said retainer sleeve between a first locking position at which said locking dogs are expanded and release positions withdrawn from within said locking dogs at which said locking dogs are free to move inwardly to release positions, the improvement which comprises: an external annular latching boss fixed along said body mandrel; an internal annular latching flange fixed in said locking sleeve; an internal annular latching recess in said locking sleeve inward of said latching flange; and said latching boss, said latching flange, and said latching recess being relatively positioned along said body mandrel and said locking sleeve to releasably latch said locking sleeve at said first position and to release said locking sleeve from said latched position when said locking sleeve is moved to one of said release positions.

5. The locking mandrel of claim 4 wherein said latching recess is longer than said latching boss providing a loose fit of said boss in said recess whereby said body mandrel and said locking sleeve are in a non-stress condition when said sleeve is at said first position.

6. The locking mandrel of claim 5 wherein the entire internal diameter of said latching flange is less than the outside diameter of said latching boss, and the relative dimensions of said internal diameter of said latching flange and the outside diameter of said latching boss effects a releasable latching relationship between said locking sleeve and said body mandrel when said locking sleeve is at said first locking positions and the material forming said body mandrel and said locking sleeve are stressed less than the elastic limit of said materials when said locking sleeve is moved between said first locking position and said release positions.

7. A locking mandrel in accordance with claim 6 wherein said locking boss is formed by an external annular cylindrical surface portion along said body mandrel and sloping end cam surfaces at opposite ends of said cylindrical surface, said latching recess and said latching flange in said locking sleeve are defined by cylindrical surfaces between opposite end sloping cam surfaces.

* * * * *